US008188679B2

(12) United States Patent
Hoogzaad

(10) Patent No.: US 8,188,679 B2
(45) Date of Patent: May 29, 2012

(54) SELF-POWERED LED BYPASS-SWITCH CONFIGURATION

(75) Inventor: Gian Hoogzaad, Mook (NL)

(73) Assignee: NXP B.V., Eindhoven (NL)

( * ) Notice: Subject to any disclaimer, the term of this patent is extended or adjusted under 35 U.S.C. 154(b) by 272 days.

(21) Appl. No.: 12/669,368

(22) PCT Filed: Jul. 16, 2008

(86) PCT No.: PCT/IB2008/052862

§ 371 (c)(1),
(2), (4) Date: Jan. 15, 2010

(87) PCT Pub. No.: WO2009/013675

PCT Pub. Date: Jan. 29, 2009

(65) Prior Publication Data

US 2010/0181923 A1 Jul. 22, 2010

(30) Foreign Application Priority Data

Jul. 23, 2007 (EP) ..... 07112964
Jul. 16, 2008 (WO) ..... PCT/IB2008/052862

(51) Int. Cl.
*G05F 1/00* (2006.01)

(52) U.S. Cl. ..... 315/294; 315/312; 315/186; 315/187; 315/185 R; 315/164

(58) Field of Classification Search ..... 315/312, 315/320, 300, 299, 291, 294, 169.1, 185 R, 315/186–188, 164, 318; 345/77, 82, 102, 345/204, 205, 211, 212
See application file for complete search history.

(56) References Cited

U.S. PATENT DOCUMENTS

| | | | | |
|---|---|---|---|---|
| 7,728,798 | B2 * | 6/2010 | Kim | 345/82 |
| 7,800,316 | B2 * | 9/2010 | Haug | 315/299 |
| 2007/0103905 | A1 | 5/2007 | Kang et al. | |
| 2010/0194274 | A1 * | 8/2010 | Hoogzaad | 315/51 |
| 2010/0315016 | A1 * | 12/2010 | Hoogzaad | 315/224 |
| 2011/0068702 | A1 * | 3/2011 | van de Ven et al. | 315/186 |
| 2011/0068713 | A1 * | 3/2011 | Hoogzaad et al. | 315/307 |

FOREIGN PATENT DOCUMENTS

| | | | |
|---|---|---|---|
| DE | 10358447 | B3 | 5/2005 |
| EP | 1 545 163 | A | 6/2005 |
| EP | 1 768 251 | A | 3/2007 |
| GB | 2 278 717 | A | 12/1994 |
| WO | 97/13307 | A | 4/1997 |
| WO | 2006/107199 | A | 10/2006 |
| WO | 2007/054856 | A2 | 5/2007 |
| WO | 2009013676 | A2 | 1/2009 |

* cited by examiner

*Primary Examiner* — Haiss Philogene

(57) ABSTRACT

A LED string is divided into segments that each have a bypass-switch and a driver for the bypass-switch. The driver is powered by a supply voltage locally generated from the forward-voltages of the LEDs of the segment.

11 Claims, 9 Drawing Sheets

SELF-POWERED LED BYPASS-SWITCH CONFIGURATION

FIELD OF THE INVENTION

The invention relates to an electronic system comprising a plurality of light-emitting diodes (LEDs) connected in series, wherein the series is divided into multiple segments. The invention also relates to a segment for use in such as system.

BACKGROUND OF THE INVENTION

LEDs are being used increasingly more and in various applications. LEDs find their ways into the backlighting of LCDs, into traffic lights and traffic signs, automobiles and domestic illumination, etc. The light output of an LED directly depends on the current flowing through the LED. A current control circuit is therefore used to regulate the current flow through the LEDs, preferably so as to maintain a constant current during all operating conditions.

Light-emitting diodes (LEDs) are driven by a specific driver circuit (driver). Typically one such driver can control one group that forms one segment of LEDs that are connected to the driver. If two or more segments (multiple groups of LEDs, each group having for example a different location or a different color) need to be driven, multiple drivers can be used or extra switches can be used in series with, or parallel to, the LEDs. Using multiple drivers is not preferred because of higher costs and larger bill-of-materials. A LED driver behaves as a current source, i.e., it has a high output-impedance. As a result, series switches are not preferred because in this way either the complete string is disconnected or parallel branches are disconnected. This gives the problem of LED impedance matching and the driver needs to switch simultaneously with the series switch to a new amplitude setting. Consequently the cost-effective choice for the extra switch is putting the switch in parallel to a portion of the LED string. Such a parallel switch is referred to as a "bypass LED dim switch" or bypass-switch. Accordingly, bypass-switches are in principle a good choice for increasing the level of segmentation without using a large number of drivers. One driver can be used to drive multiple segments.

However, problems may occur regarding the control of the bypass-switch. The bypass-switch needs to be reliably controlled by a stable pulse width modulated (PWM) control signal at a phase required by the system. This stable PWM signal ensures the required brightness setting and required color stability in case of, e.g., RGB LED systems. The bypass-switch needs to operate in an environment where large common mode variations occur because of bypass actions from other bypass-switches used in the LED string. These other bypass-switches have in principle their own, individually programmed and independent PWM control signal and phase. As a result, the challenge in operating the bypass-switch is in providing stable reliable operation in an electrical environment that experiences large common mode variations.

SUMMARY OF THE INVENTION

An application simultaneously filed by the same inventor (reference number 008291EP1, applicant NXP B.V.) describes a replacement of the supply filter capacitor by capacitors per segment in parallel with the bypass switches. In one described embodiment the segment capacitors as described in said document can be disconnected from the LED string, operating as a sample and hold circuit. Disconnecting the capacitors from the LED string during LED segment off-time and reconnect during LED on-time results in an improved PWM accuracy and power efficiency. Due to their capacity size these capacitors can fulfill a double function. Apart from operating as filter capacitor when connected to the LED string, they can operate as power source for the bypass switch and its driver in the disconnected from LED string mode. Consequently the hold function in the segment capacitor is now used to have a continuous supply available for the bypass-switch driver that is automatically at the proper common mode level.

In the invention, the power supply for the driver of the bypass-switch within the segment is locally drawn from the LED string. As a result, additional power supply lines and voltage regulators, in combination with an overall power supply source, are not required. The segments not requiring an additional power supply for operation consequently is defined as self-powered.

More specifically, the invention relates to an electronic system comprising a plurality of LEDs, connected in series. The series circuit is divided into multiple segments. Each specific one of the segments comprises a series connection of one or more of the LEDs between first and second nodes of a current path of the specific segment. Each segment further comprises: a bypass-switch connected between the first and second nodes and in parallel with the one or more LEDs, and a driver for controlling the bypass-switch. The driver has first and second supply terminals. Each segment also comprises a capacitance connected between the first and second supply terminals of the driver. According to the invention power supply is locally generated from the current path within the segment, and particularly from the forward-voltages of the LEDs of the segment. This can be achieved adequately with a gating element for supply of a current to the capacitance. The gating element is connected between the current path and the capacitance. The gating element is operative to generate for the driver a power supply at the capacitance that is derived from a forward-voltage of the one or more LEDs. For example, the gating element is a diode having its anode connected to the current path. As another example, the gating element comprises a sample switch between the current path and the capacitance, and a sample driver for control of the sample switch. The sample driver has a third supply terminal connected to the first supply terminal and a fourth supply terminal connected to the second supply terminal.

In one embodiment of the system, one or more of the segments each comprise a voltage regulator between the capacitance and the first supply terminal. Use of the voltage regulator is advisable if the forward-voltage of the LEDs varies as a result of, e.g., process parameter spread, temperature, aging, etc.

In a further embodiment, a particular one of the segments has a single LED between the first and second nodes of its current path. The particular segment comprises a voltage up-converter for increasing a voltage between the first and second supply terminals if the bypass-switch in the particular segment is conducting. For example, the up-converter comprises first and second capacitors, and control circuitry. The control circuitry is operative to connect the first and second capacitors in parallel between the first and second supply terminals if the bypass-switch in the particular segment is blocking, and for connecting the first and second capacitors in series between the first and second supply terminals if the bypass-switch of the particular segment is conducting. The forward-voltage of a single LED can be too low for supplying the driver of the bypass-switch. An up-converter then remedies this mismatch.

In yet a further embodiment, a particular one of the segments has two or more LEDs connected in series between the first and second nodes of the current path of the particular segment; and the gating element is connected to the current path between a pair of the two or more LEDs. This configuration is advisable if the combined forward-voltage of all series connected LEDs in the particular segment is higher than needed to derive the local power supply.

The invention further relates to a segment for use in the system in the invention. Note that, by having the driver's power supply locally generated in the segment, a modular configuration of a LED string system is easier than in the known systems. The latter require a grid of power supply lines from a shared source to each of the segments.

In one specific embodiment, the driver, the gating element and the bypass-switch of the segment are combined into a single integrated circuit. This integration of different elements is enabled by the segmentation. The voltage drop per segment is limited.

Therefore, the required voltage stability of the integrated circuit is limited. Hence, integration is possible, even in a CMOS process. Instead, without the segmentation, the required breakdown voltage of bypass switch and driver would be different to such extent that combination into a single IC does not make any sense. Suitably, a drive signal level shifter is also integrated into this integrated circuit. Also further components, such as a sample and hold switch could be integrated.

BRIEF DESCRIPTION OF THE DRAWINGS

The invention is explained in further detail, by way of example and with reference to the accompanying drawing, wherein.

Throughout the Figures, similar or corresponding features are indicated by same reference numerals.

DETAILED DESCRIPTION OF EMBODIMENTS

Figure 1:
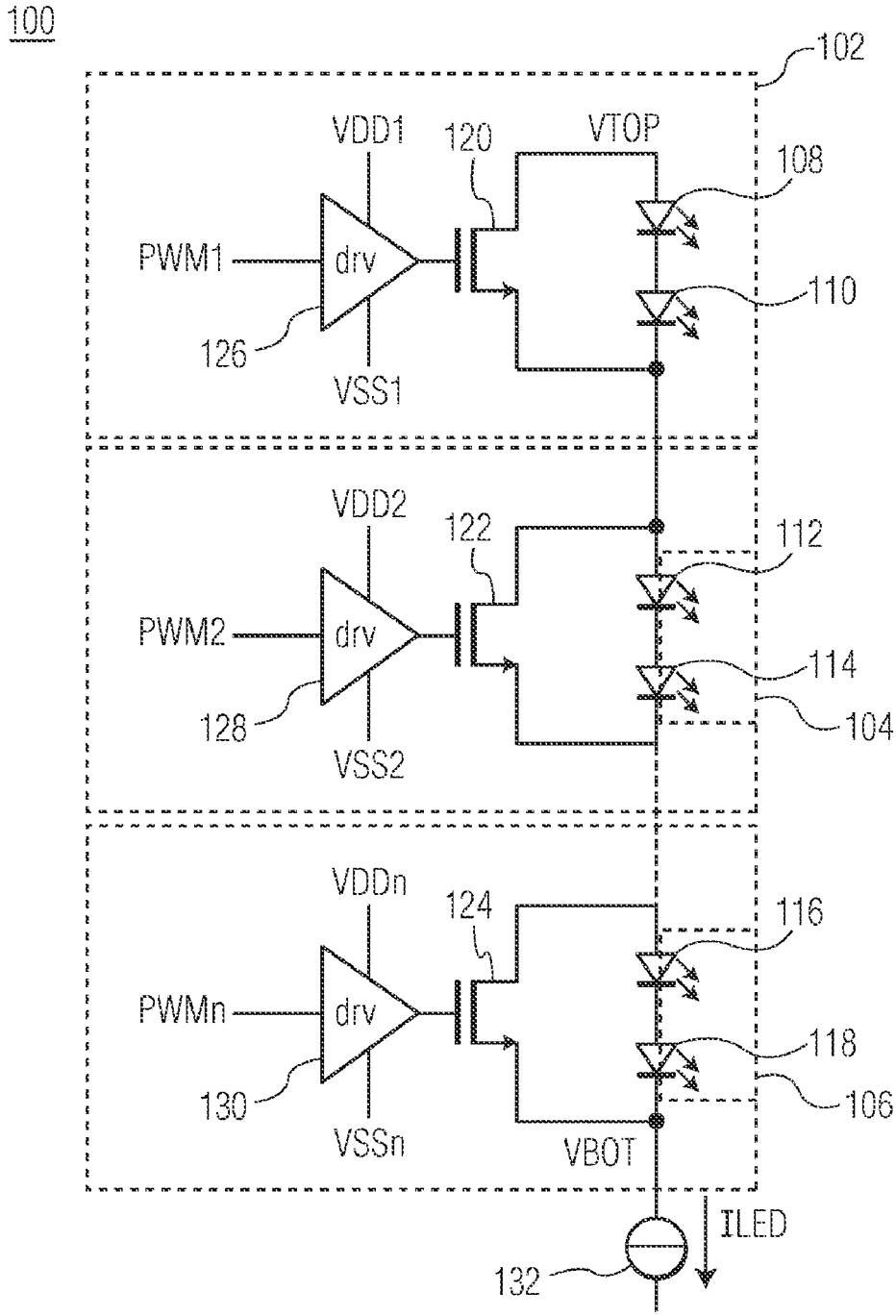
FIG. 1 (PRIOR ART)
FIG. 1 is a diagram of a generic LED string circuit.

FIG. 1 is a diagram of a generic type of LED string circuit 100 comprising segments 102, 104, . . . , and 106. Segment 102 comprises multiple LEDs, LED 108 and LED 110 are shown, connected in series. Segment 104 comprises multiple LEDs, LED 112 and LED 114 are shown, connected in series. Segment 106 comprises multiple LEDs, LED 116 and LED 118 are shown, connected in series. Each of segments 102-108 has a respective bypass-switch 120, 122 and 124 connected in parallel to the respective series connection of LEDs. Each of segments 102-108 has a respective driver 126, 128 and 130 that is supplied via the power supply terminals VDD1, VDD2, . . . , VDDn respectively and VSS1, VSS2, VSSn respectively, and that receives drive information (PWM1, PWM2, PWMn, respectively) at its input terminal so as to control bypass-switches 120-124. The string of LEDs 108-118 is driven by a current source 132. Current source 132 can be connected to the top (anode) or bottom (cathode) of the LED string. Current source 132 is typically a switch-mode type of driver. The combination of such a current source with bypass-switches 120-124 parallel to the LED series connections 108-110, 112-114 and 116-118 is power-efficient. Bypass-switches 120-124 can be, e.g., n-type MOSFETs, but can be any type of switch or transistor. The means to provide the multitude of power supplies VDD/VSS for the bypass-switch drivers 126-130 is addressed below.

Figure 2:
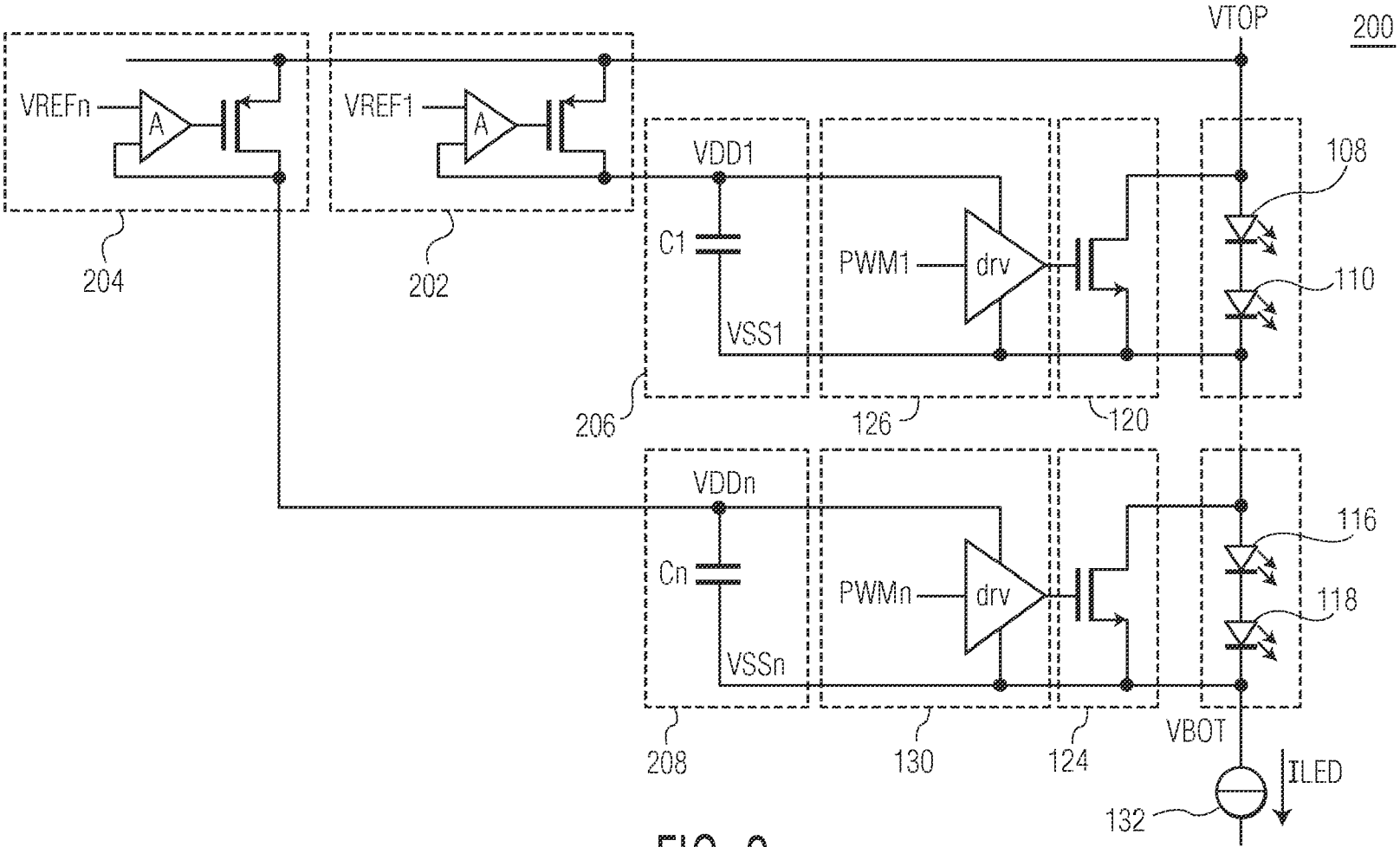
FIG. 2 (PRIOR ART)
FIG. 2 is a diagram of a known LED string circuit.

FIG. 2 is a diagram of a known LED string circuit 200., wherein the supply for bypass-switch drivers 126-130 is derived from the highest supply voltage available within circuit 200, e.g., Vtop at the anode of the string of LEDs. Voltage regulators 202 and 204 are provided, here depicted as a linear one, but can be of any suitable type. Regulators 202, . . . , 204 receive reference voltages VREF1, . . . , VREFn, respectively. Regulator 202 supplies driver 126, a capacitor 206 being arranged in parallel with the supply terminals of driver 126 and bypass-switch 120. Regulator 204 supplies driver 130, a capacitor 208 being arranged in parallel with the supply terminals of driver 130 and bypass-switch 124. Capacitors 206 and 208 serve to stabilize the output voltage of regulators 202 and 204, respectively, and to lower their high-frequency output impedances.

The configuration of known circuit 200 has the following characteristics. Per bypass-switch, one regulator and one supply capacitor are needed, that have to be designed so as to provide an excellent (high-frequency) common mode rejection. That is, the nodes in the LED string experience high-frequency fluctuations in their voltages relative to ground as a result of the bypass-switch activities in neighboring segments. The voltages affecting operation of the bypass-switches and their drivers need to be able to withstand these fluctuations. Reference voltages VREF1, . . . , VREFn and driver control information signals PWM1, . . . , PWMn must follow the levels of voltages VSS1, . . . , VSSn, respectively. This owes to the fact that the reference for regulators 202 and 204: VTOP, and the reference for the PWM signals: typically the ground for signals of the microprocessor of the system (not shown) are different from the reference of the bypass segments: VSS1, . . . , VSSn. For LED segment 108-110 connected to VTOP there may be a voltage headroom issue, because during bypassing (i.e., when switch 120 is conducting) VSS1 equals VTOP and regulator 202 consequently cannot regulate VDD1 to a higher value than VTOP. As a result there is no driving voltage available for driver 126. The efficiency of circuit 200 can be poor resulting from the use of linear regulators 202-204: the power required for bypass drivers 126 and 130 is largely dissipated by regulators 202 and 204, especially by regulator 204 driving the lower segment. In addition, circuit 200 requires many supply lines, connecting to all segments.

Figure 3:
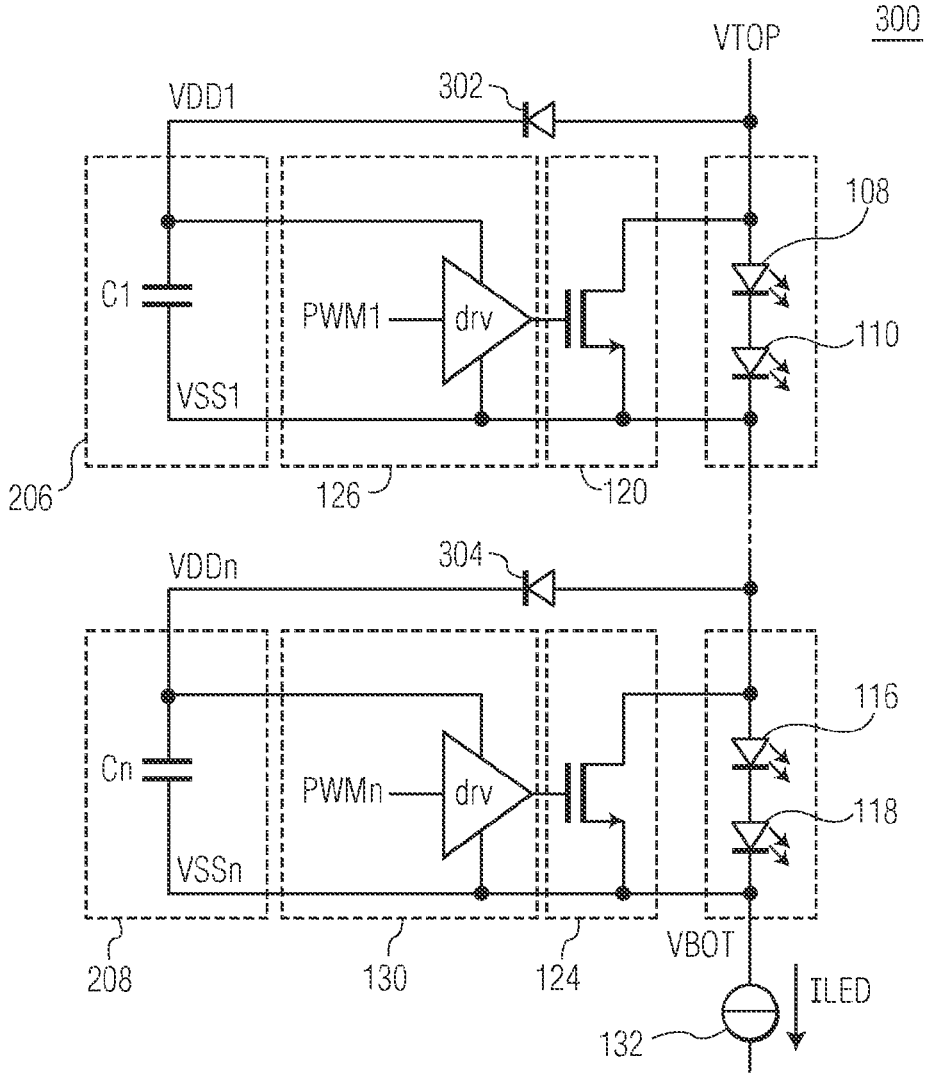
FIGS. 3, 4, 5, 6,7,8 and 9 are diagrams of LED string circuits according to the invention.

FIG. 3 is a diagram of a first circuit 300 in the invention. In accordance with the invention, the LED string, composed of the series connection of LEDs 108, 110, . . . , 116 and 118, is now being used to generate the supply voltages for drivers 126-130. More specifically, circuit 300 comprises diodes 302, . . . , 304. Diode 302 is connected in series with supply capacitor 206, and this series connection is arranged in parallel with LEDs 108-110. Diode 304 is connected in series with supply capacitor 208, and this series connection is arranged in parallel with LEDs 116-118. Diode 302 charges supply capacitor 206 to a voltage that is one diode-voltage lower than the peak voltage across LEDs 108-110. Similarly, diode 304 charges supply capacitor 208 to a voltage that is one diode-voltage lower than the peak voltage across LEDs 116-118. As a result, there is no voltage regulator required to define the supply voltages for drivers 126 and 130. Only a LED string powered supply capacitor is required per bypass-switch. Note that there is no level-shifting circuitry required as in circuit 200. The control signals PWM1, . . . , PWMn for drivers 126, . . . , 130 respectively, should follow VSS1, . . . , VSSn signals, respectively. A level-shifter can be used for this as is explained with reference to FIG. 8 further below. Unlike circuit 200, circuit 300 does not feature any voltage headroom issues with the voltage supply to the top segment with LEDs 102-110. Furthermore, the wiring for the supply voltages is much simpler than in circuit 200.

As mentioned, diodes 302-304 charge supply capacitors 206 and 208 to one diode-voltage lower than the peak voltage across LED series connections 108-110 and 116-118. Circuit 300 is designed to consume as little power as possible in order to not draw a significant current from the LED string to capacitors 206-208. However, a possibly wide variability exists regarding the number of LEDs per circuit which depends on the design, and regarding the dependence of the LED's forward-voltage Vf on process spread, temperature, ageing and other parameters. The forward-voltage Vf of a diode is the voltage drop over the diode in operational use of the diode.

Figure 4:
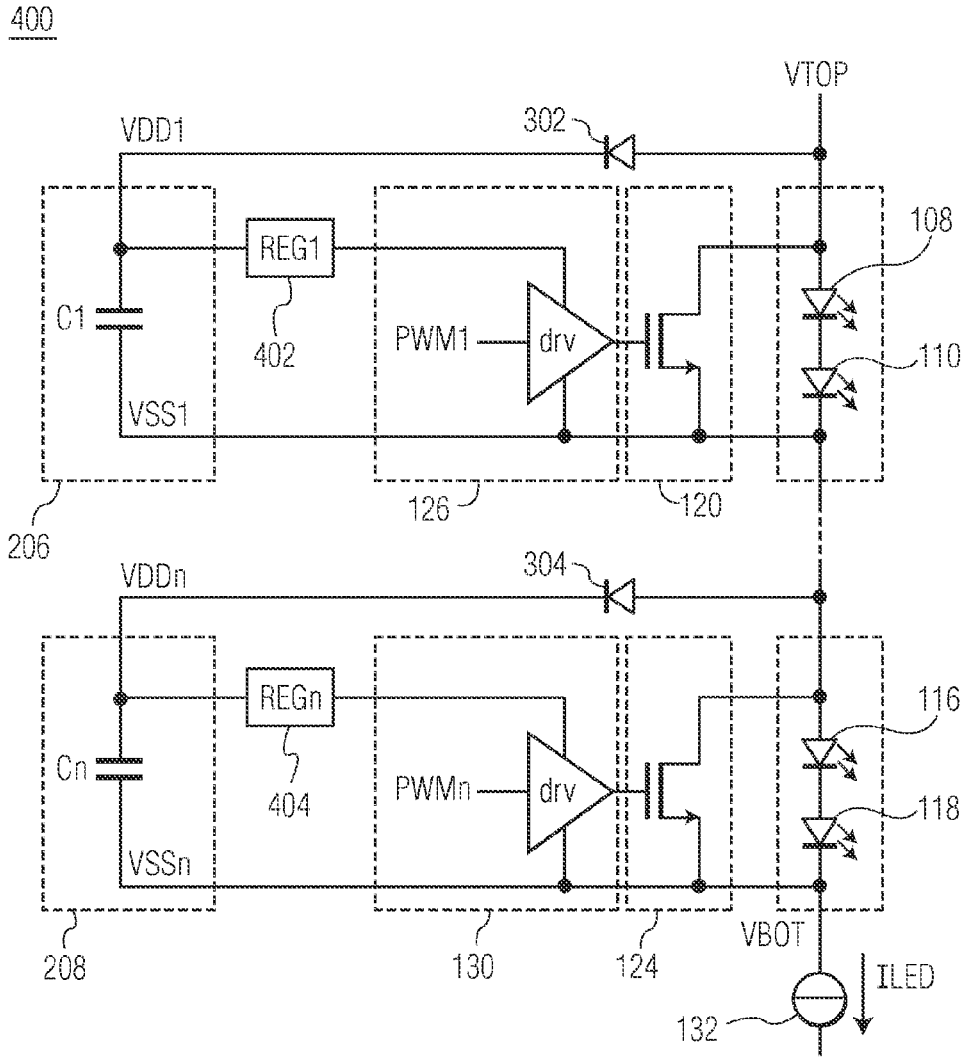

FIG. 4 is a diagram of a circuit 400 that takes above dependences into account. Circuit 400 is based on circuit 300, but it now comprises local voltage regulators 402 and 404 as part of the driver hardware. Examples of embodiments of regulators 402 and 402 are, linear regulators as regulators 202 and 204 of FIG. 2, buck converters or capacitive down-converters. These are then connected between VDD and VSS.

Figure 5:
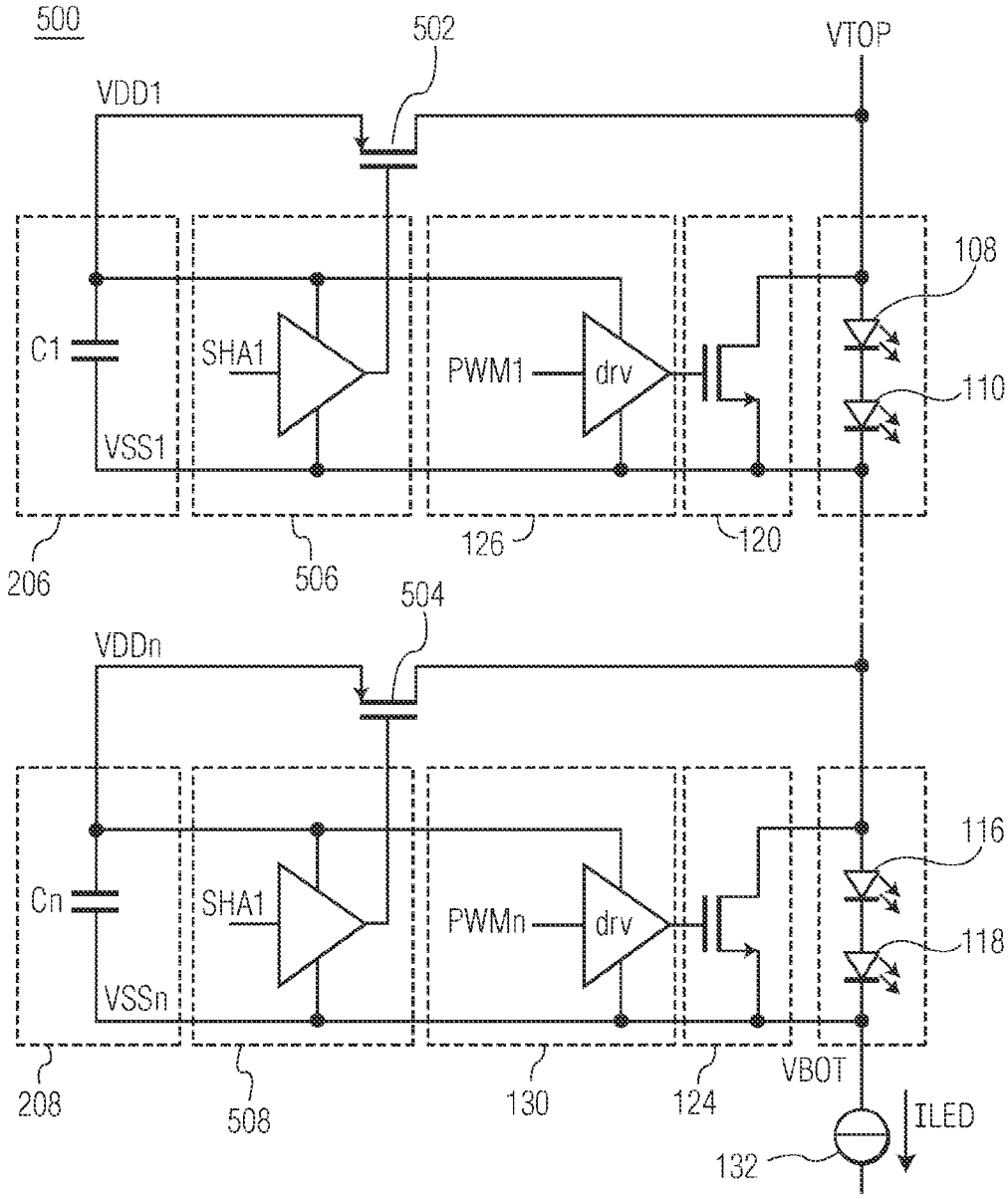

FIG. 5 is a diagram of a further embodiment 500 of the self-powered concept, wherein supply capacitors 206-208 are combined with filter capacitors to reduce the ripple current through LEDs 108-110 and 116-118 relative to the ripple current from current source 132. As current can flow in both directions during turn-on of switch 120 and/or switch 124, supply capacitors 206 and 208 also function as filters. In embodiment 500, diodes 302-304 of circuit 300 have been replaced by switches 502-504 which can be sourced from several types. Switches 503-504 are connected in the VDD line (as illustrated). Alternatively, switches 502-504 can also be implemented in the VSS line. Care needs to taken when using switches (502-504) with built-in protection diodes. The direction of these protection diodes must be similar as the direction for diodes 302-304 to prevent discharge of supply capacitors 206-208 during activation of the associated one of bypass-switches 120-124. Likewise, this concept can also be applied to modify circuit 400.

Switches 502-504 function as sample switches, driven by a respective one of sample drivers 506-508. In order to prevent a short-circuit of supply capacitors 206-208 via bypass-switches 120-124, a non-overlapping activation scheme is employed for switches 120 and 502 (and also for switches 124 and 504). This is explained below with respect to LEDs 108-110. In a first phase, bypass-switch 120 is blocking and switch 502 is conducting. In this phase, the voltage across LEDs 108-110 are filtered by capacitor 206. In a second phase, switch 502 is put into a blocking state, and capacitor 206 samples and holds the voltage over LEDs 108-110 existing at that moment. A short time after that, e.g., 20 nsec, bypass-switch 120 is put into a conducting state in order to turn off LEDs 108-110. Bypass-switch 120 is kept in the conducting state for a certain PWM time period. In a third phase, bypass-switch 120 is put into a blocking state so as to turn on LEDs 108-110. Shortly thereafter, in a fourth phase, switch 502 is put into the conducting state so as to connect capacitor 206 across LEDs 108-110. During the small disconnect time of capacitor 206, the current through LEDs 108-110 is filtered by the parasitic capacitors of LEDs 110-118.

Figure 6:
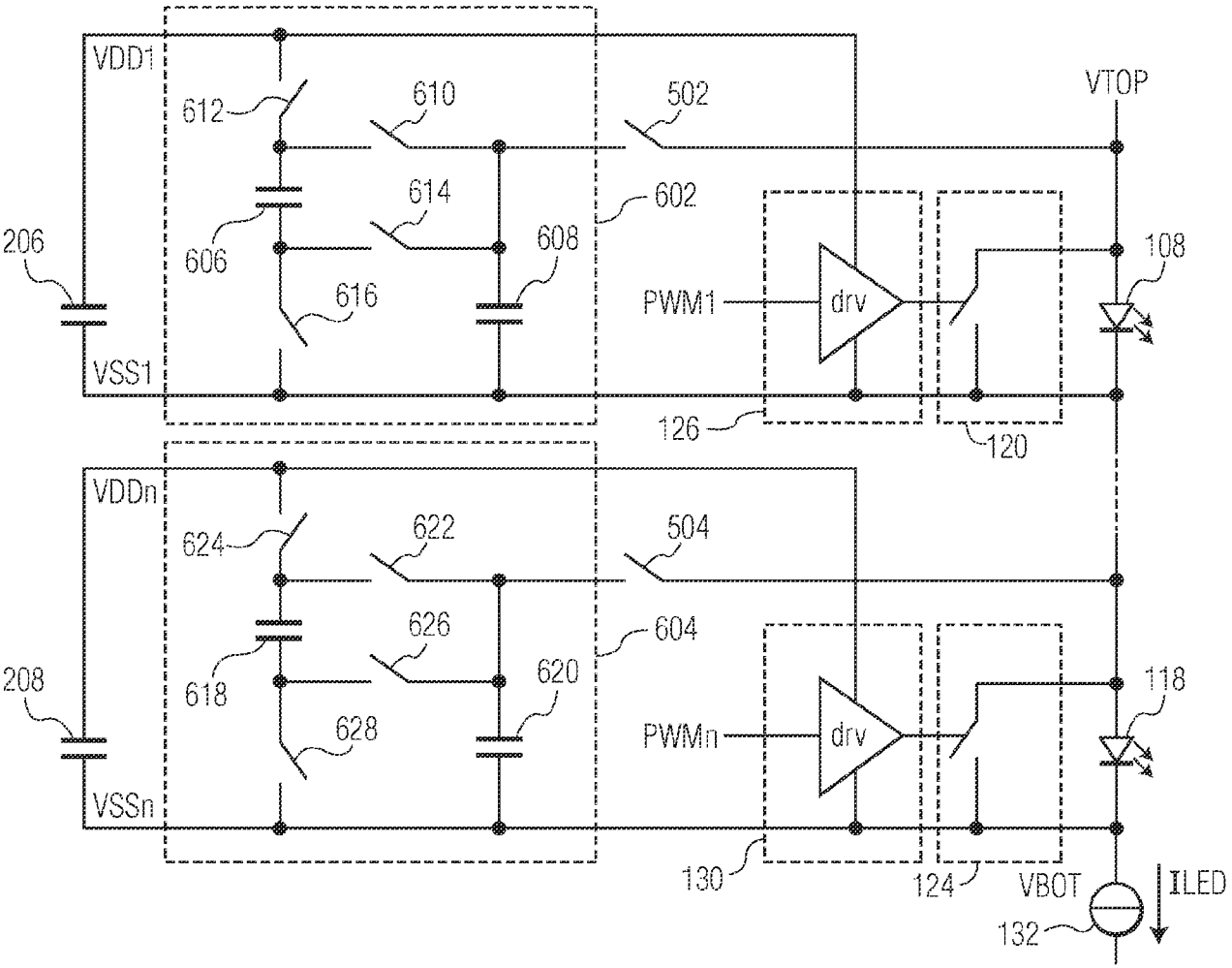

FIG. 6 is a diagram of a circuit 600 wherein the segments illustrated each comprise a single LED, in this case LED 108 and LED 118. Basically, the configurations of circuits 300, 400 and 500 could be maintained. However, the forward-voltage Vf of a single LED could be too small for supplying bypass-switch drivers 126 or 130. For example, a hot-red LED has a Vf of 2V. Therefore up-converters are provided. Circuit 600 comprises capacitive up-converters 602 and 604.

Functionally, up-converter 602 comprises capacitors 606 and 608, and switches 610, 612, 614 and 616 and their drivers (not shown in order to not obscure the drawing). Similarly, up-converter 604 comprises capacitors 618 and 620, and switches 622, 624, 626 and 628 and their drivers (not shown in order to not obscure the drawing). The drivers that are not shown preferably receive their power supply in a manner similar to driver 126 and driver 506, namely via capacitor 206 or capacitor 208.

Although up-converters 602 and 604 are depicted as capacitive doublers up-conversion factors other than two can be designed. Operation is explained with respect to the top segment with LED 108. During non-conductivity of bypass-switch 120, LED 108 is producing light. In this state, switches 610-614 are controlled so that capacitors 606 and 608 are connected in parallel between the VDD1 and VSS1 supply lines. Connected in parallel, capacitors 606 and 608 function as filtering capacitors for the current through LED 108.

During conductivity of bypass-switch 120, LED 108 is turned off. Then, switches 610-618 are controlled so that capacitors 606 and 608 are connected in series between the VDD1 and VSS1 supply lines. As a result, the voltage towards buffer capacitor 206 is doubled. The voltage over capacitor 206 is used to supply the driver of, e.g., bypass-switch 126 and the drivers of switches 502, 610-618. This concept can also be extended with local regulators 402 and 404 as discussed under FIG. 4.

An embodiment of a system in the invention accommodates segmented LED driver circuitry, wherein the number of LEDs connected in series per segment is so large that, as a result, the voltage across the segment's series connection is too high to provide the power supply for the driver circuitry. If many series-connected LEDs are present per segment (and per bypass-switch), then a smaller number of series-connected LEDs can be used to derive the supply voltage from. This is illustrated with reference to FIG. 7.

Figure 7:
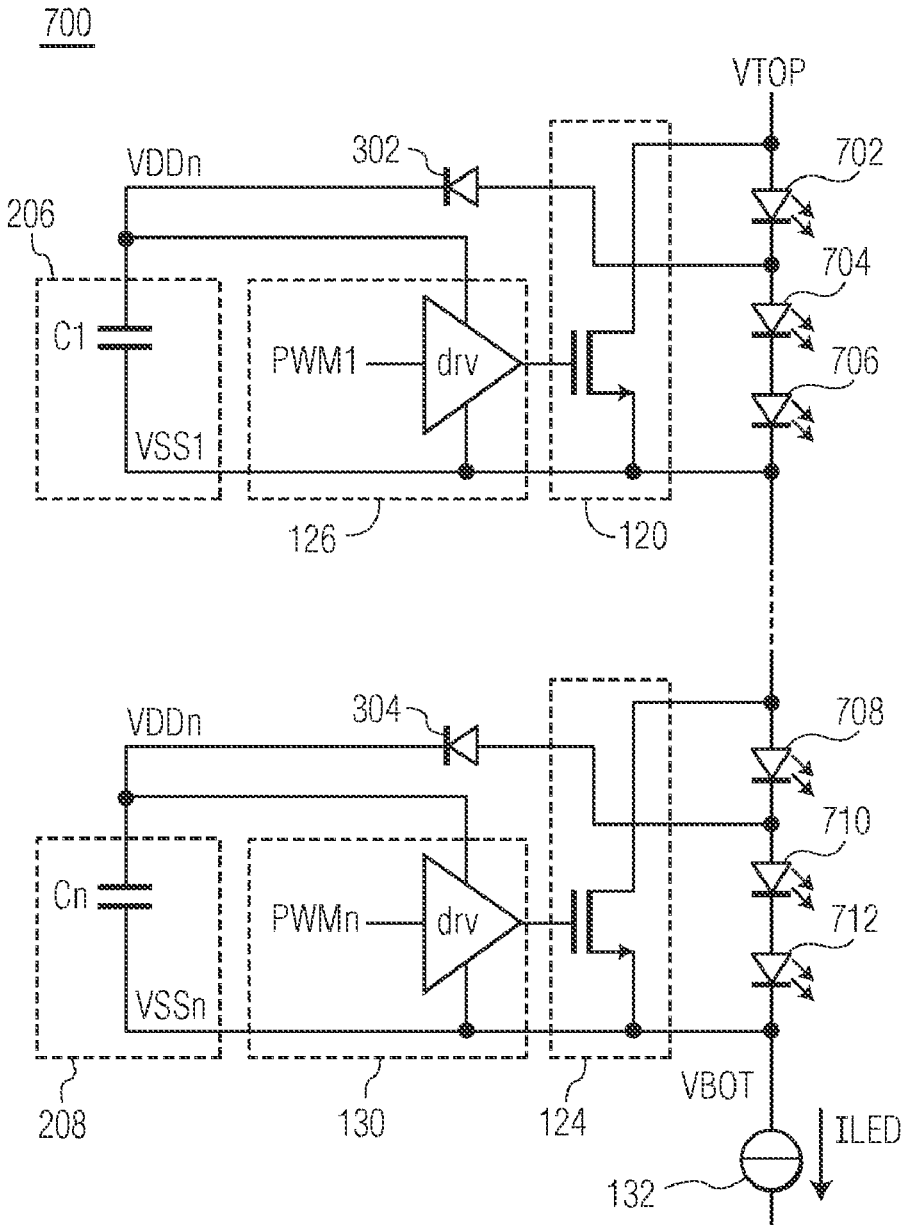

FIG. 7 is a diagram of a circuit 700 in the invention. Circuit 700 comprises multiple segments wherein only the top segment and the bottom segment have been drawn.

The top segment comprises a series connection of LEDs 702, 704 and 706.

The bottom segment comprises a series connection of LEDs 708, 710 and 712.

In the diagram, the segments are shown to have identical configuration, but they could have different configurations instead, e.g., different numbers of series-connected LEDs. Operation is explained with reference to the top segment. The voltage over the series-connected LEDs 702-706 may be too high in order to power, via supply capacitor 206, driver 126 of bypass-switch 120. Therefore, the anode of diode 302 is not connected to one end of the full series-connection, but to a node between two LEDs, here the node between LED 702 and LED 704.

As a consequence, the voltage drop between VDD1 and VSS1 is lower, in this example by a forward-voltage Vf of LED 702, than the voltage drop over the complete series-connection of LEDs 702-706 in this segment.

Figure 8:
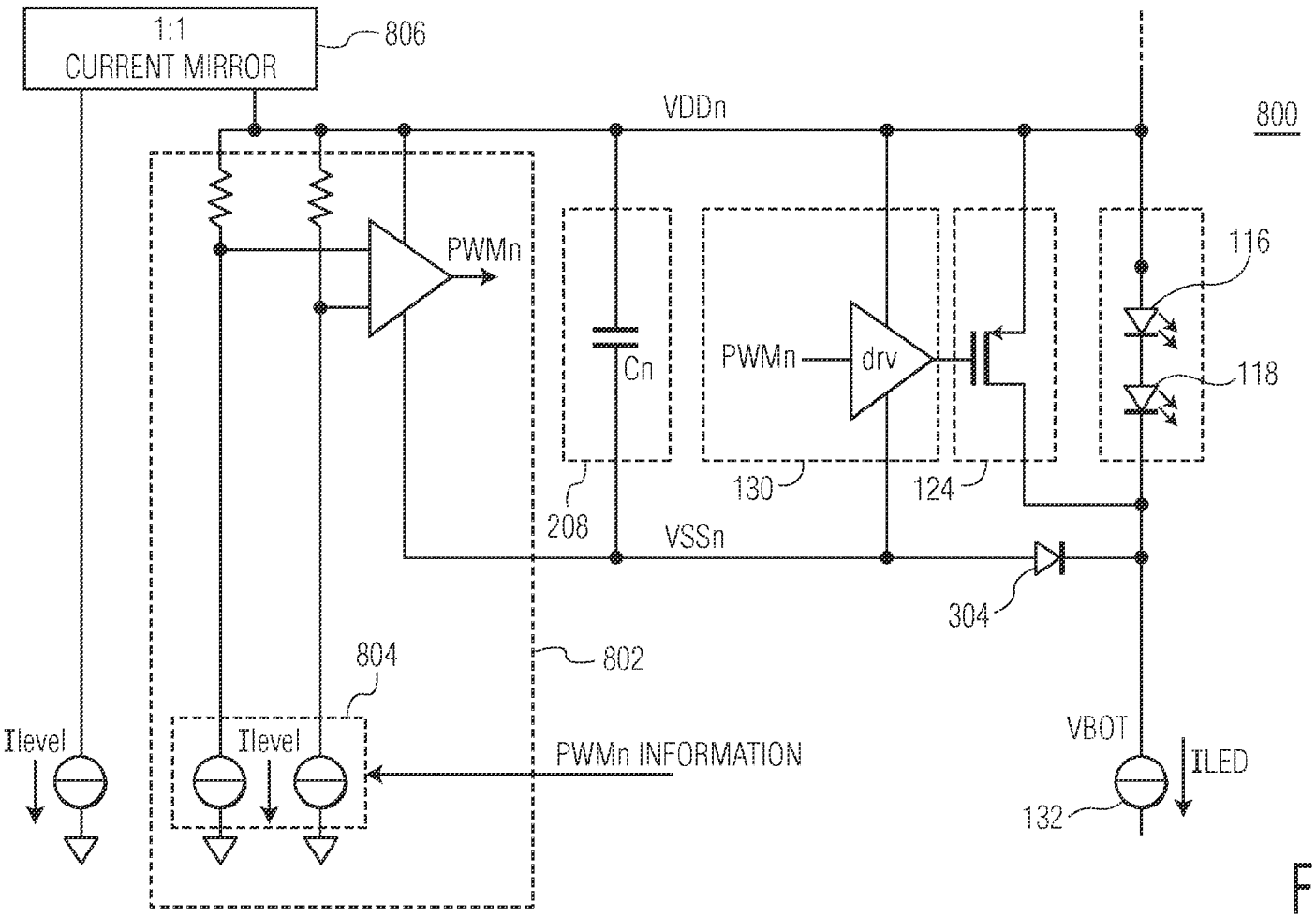

FIG. 8 is a diagram of another circuit (800) supporting the invention. As discussed under FIG. 3, level-shifting can be used to force driver control signals PWM1, . . . , PWMn follow the VSS1, . . . , VSSn levels. This is explained with reference to the segment shown in circuit 800, which is the lower segment of the string. Circuit 800 comprises a level-shifter 802 driven by differential current sources 804 (one is on while the other is off). Level-shifter 802 shifts PWM1 drive information from signal ground to the level required by the relevant segment. The combination of level-shifter 802, connected to VDDn, with diode 304, connected to VSSn, serves to prevent level-shifter 802 from discharging capacitor 206 during bypassing of LEDs 116-118, i.e., when LEDs 116-118 are turned off and capacitor 208 is not charged by the voltage over LEDs 116-118. Furthermore, the current drawn by current sources 804 from the VDDn node can be compensated by injecting a current of the same magnitude into the VDDn node. Level-shifter 802 sinks a current of size Ilevel (see FIG. 8) from the LED string. An additional current source 808 with current mirror 806 can be used to source a current of the same magnitude to avoid any impact on the charge status of the capacitor 206.

Figure 9:
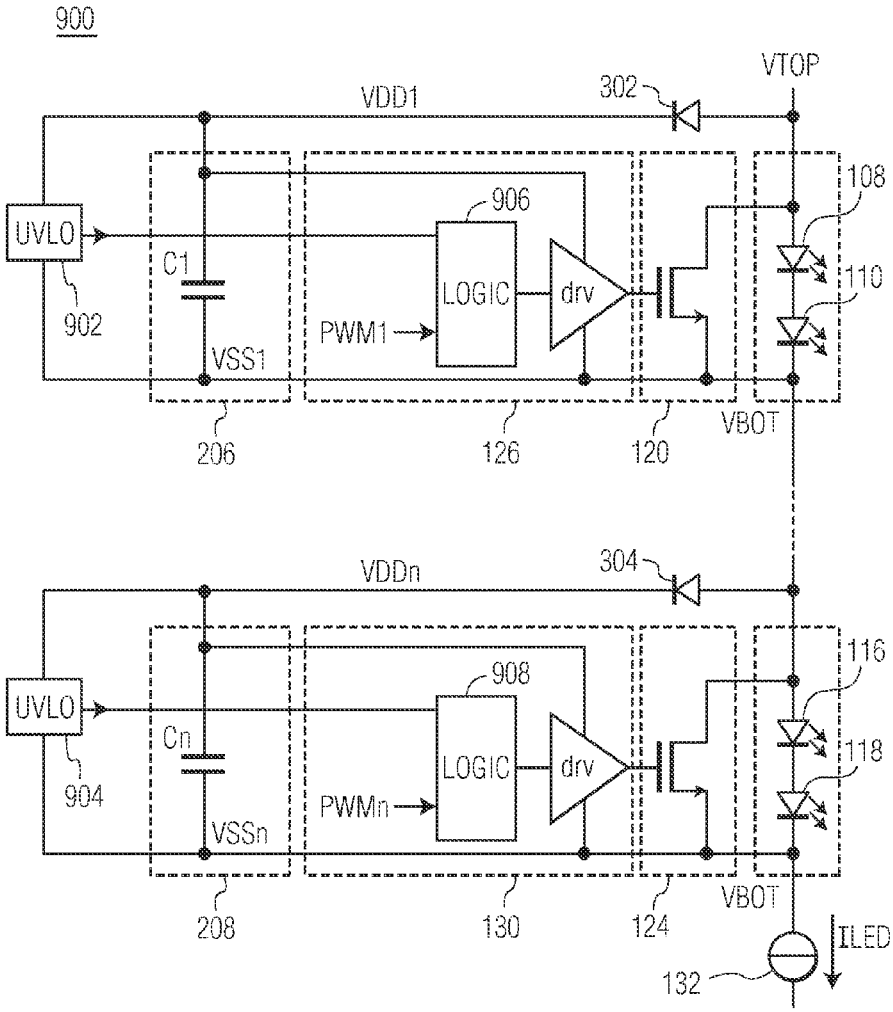

FIG. 9 is a block diagram of a circuit 900 in the invention that comprises under-voltage lock-out (UVLO) circuits 902, . . . , 904. Operation is explained with respect to the upper segment. The operation of the other segments is similar. UVLO circuit 902 monitors the voltage across supply capacitor 206, and upon detection of this voltage dropping below a level too low for safe operation, bypass-switch 120 is turned off for a short interval. Driver 126 is provided with control logic 906 so as to overrule the PWM1 signal, if the latter signal has a value that would otherwise cause driver 126 to put bypass-switch 120 into a conducting state. As a result, capacitor 206 is charged from the LED string with minimal impact on the light output. Supply capacitor 206 can discharge in the event of a prolonged period of bypass-switch 120 turned-on, together with some inevitable bias or leakage current taken from supply capacitor 206 by driver 126, diode 302 and all possible circuitry connected to capacitor 206 such as UVLO circuit 902 and logic circuit 906. UVLO circuit 902 functions in that case as a protection against unpredictable behavior of driver 126, for example, a hang-up. Similar operation occurs in the other segments, e.g., the lower segment having UVLO circuit 904 and control logic 908.

In an embodiment of the invention, all driver and switch functionality is integrated in an integrated circuit (IC), including level-shifters for the PWM signals and optionally including voltage regulator 402. A module can thus be implemented with driver IC 126, LEDs 108-110 and capacitor 206 (plus PWM level-shifter and/or regulator 402 if so desired) as a basic component for a customizable, scaleable LED system of one or more segments.

The invention can be used in all kinds of LED applications such as general lighting, LCD backlighting, automotive lighting, etc., wherein bypass dim switches provide a cost-effective solution for segmenting the collection of LEDs.

In above examples, the segments are shown as including a single bypass-switch in parallel with a series connection of LEDs, e.g., LEDs 108-110 and LEDs 702-706. The segmentation is then a linear (or: one-dimensional) one. Some applications may require per segment a parallel arrangement of two or more branches of LEDs, each branch comprising one or more LEDs. Each specific one of the branches may have its own specific bypass-switch controlled by its own specific driver. Alternatively, two or more of the parallel branches are controlled via a single bypass-switch controlled by a single driver. The segmentation is then two-dimensional.

The invention claimed is:

1. An electronic system comprising a plurality of LEDs connected in series, wherein:

the series is divided into multiple segments;

each specific one of the segments comprises:

a series connection of one or more of the LEDs between first and second nodes of a current path of the specific segment;

a bypass-switch connected between the first and second nodes and in parallel with the one or more LEDs;

a driver for controlling the bypass-switch, the driver having first and second supply terminals;

a capacitance connected between the first and second supply terminals;

wherein power supply of the driver is locally generated from the current path within the specific segment; and wherein the local power supply is embodied with a gating element for supply of a current to the capacitance the gating element is connected between the current path and the capacitance; and the gating element is operative to generate for the driver a power supply at the capacitance that is derived from a forward-voltage of the one or more LEDs.

2. The system of claim 1 further comprising a monitoring circuit for monitoring a capacitance voltage across the capacitance and for turning off the bypass-switch in dependence on the capacitance voltage.

3. The system of claim 1, wherein the gating element is a diode having its anode connected to the current path.

4. The system of claim 1, wherein:

the gating element comprises a sample switch between the current path and the capacitance, and a sample driver for control of the sample switch; and the sample driver has a third supply terminal connected to the first supply terminal, and a fourth supply terminal connected to the second supply terminal.

5. The system of claim 1, further comprising a voltage regulator between the capacitance and the first supply terminal.

6. The system of claim 1, wherein:

the specific segment comprises a voltage up-converter for increasing a voltage between the first and second supply terminals if the bypass-switch in the specific segment is conducting.

7. The system of claim 6, wherein the up-converter comprises:

a first capacitor and a second capacitor; and circuitry for connecting the first and second capacitors in parallel between the first and second supply terminals if the bypass-switch in the specific segment is blocking, and for connecting the first and second capacitors in series between the first and second supply terminals if the bypass-switch of the specific segment is conducting.

8. The system of claim 1, wherein:

a selected one of the segments has two or more LEDs connected in series between the first and second nodes of the current path of the specific segment; and the power supply is drawn from the current path between a pair of the two or more LEDs.

9. A segment comprising:

a series connection of one or more of the LEDs between first and second nodes of a current path of the segment;

a bypass-switch connected between the first and second nodes and in parallel with the one or more LEDs;

a driver for controlling the bypass-switch, the driver having first and second supply terminals;

a capacitance connected between the first and second supply terminals wherein power supply of the driver is locally generated from the current path within the segment.

wherein a gating element is present for supply of a current to the capacitance, the gating element is connected between the current path and the capacitance; and the gating element is operative to generate for the driver a continuous power supply at the capacitance that is derived from a forward-voltage of the one or more LEDs.

10. The segment according to claim 9, wherein the bypass switch, the driver and the gating element are combined into an integrated circuit.

11. The segment of claim 10, further comprising a drive-signal level shifter integrated in the integrated circuit.

* * * * *